US006008833A

United States Patent [19]

Ohtsubo et al.

[11] Patent Number: 6,008,833

[45] Date of Patent: Dec. 28, 1999

[54] LIGHT-EMITTING DEVICE AND IMAGE FORMING APPARATUS USING THE SAME

[75] Inventors: Toshihiko Ohtsubo, Machida; Hiroshi Tanioka, Yokohama; Mitsuru Amimoto, Yokohama; Shigeo Hata, Yokohama, all of Japan

[73] Assignee: Canon Kabushiki Kaisha, Tokyo, Japan

[21] Appl. No.: 08/651,702

[22] Filed: May 21, 1996

[30] Foreign Application Priority Data

May 23, 1995 [JP] Japan ..... 7-123668

[51] Int. Cl.[6] ..... B41J 2/47; B41J 2/435; B41J 2/45; B41J 2/39; B41J 2/40; B41J 2/395

[52] U.S. Cl. ..... 347/237; 347/148; 347/238

[58] Field of Search ..... 347/237, 238, 347/132, 130, 13, 182, 148; 345/82

[56] References Cited

U.S. PATENT DOCUMENTS

| | | | |
|---|---|---|---|
| 3,803,631 | 4/1974 | Nucklos et al. | 346/35 |
| 4,653,895 | 3/1987 | Deguchi et al. | 355/1 |
| 4,689,694 | 8/1987 | Yoshida | 347/237 X |
| 4,703,334 | 10/1987 | Mochimura et al. | 347/130 |
| 5,034,757 | 7/1991 | Godlove | 347/237 |
| 5,210,472 | 5/1993 | Casper et al. | 315/349 |
| 5,489,933 | 2/1996 | Betsui et al. | 347/120 |

FOREIGN PATENT DOCUMENTS

| | | | |
|---|---|---|---|
| 4-255368 | 9/1992 | Japan | 347/238 |
| 5-212906 | 8/1993 | Japan . | |

*Primary Examiner*—John Barlow
*Assistant Examiner*—Thinh Nguyen
*Attorney, Agent, or Firm*—Fitzpatrick, Cella, Harper & Scinto

[57] ABSTRACT

A light-emitting device includes a number of light-emitting element groups each including a plurality of light-emitting elements, a first drive device for driving the plurality of light-emitting elements in succession, and a number of resistance sections, each separately connected to each of the light-emitting element groups. The resistance section is connected in common to the plurality of light-emitting elements. The light-emitting device further includes a second drive device for driving the light-emitting element groups.

10 Claims, 10 Drawing Sheets

| FIG. 8A | FIG. 8B |
|---|---|

LIGHT-EMITTING DEVICE AND IMAGE FORMING APPARATUS USING THE SAME

BACKGROUND OF THE INVENTION

1. Field of the Invention

This invention relates to a light-emitting device, and particularly to a light-emitting device suitable for use in an image forming apparatus such as a copying apparatus, a facsimile apparatus or a printer.

2. Related Background Art

An LED recording head is comprised of a number of LED chips and a drive IC for driving them linearly mounted on a substrate, and when it is used, for example, in a copying apparatus, light is applied from an LED element onto a photosensitive drum to thereby form a latent image.

FIGS. 1A and 1B of the accompanying drawings are a schematic circuit diagram and a cross-sectional view, respectively, showing the construction of an LED head accord ing to the prior art. LED elements 1-1, 1-2, . . . , 1-5 linearly arranged in an LED chip 1 are connected to transistors 4-1, 4-2, . . . , 4-5 in a drive IC 10 in one-to-one relationship by bonding wires 2-1, 2-2, . . . , 2-5. Limiting resistances 3-1, 3-2, 3-5 prescribe electric currents for driving the LED elements 1-1, 1-2, . . . , 1-5 they take under their charge. In the drive IC 10, there are provided the limiting resistances 3-1, 3-2, . . . , 3-5, the transistors 4-1, 4-2, . . . , 4-5 and a control section 5. The LED chip 1 and the drive IC 10 are disposed on one and the same substrate 6.

Now, it is known that an LED is generally reduced by about 1% in its light emission intensity for a one-degree rise of environmental temperature, and to effect image reproduction of high quality, it is important to suppress a temperature rise including that of the drive IC 10. When the fluctuation of this output is great, the application is limited to only binary recording.

In the prior-art LED recording head of FIGS. 1A and 1B, generally the limiting resistances 3-1, 3-2, . . . , 3-5 substantially determine the temperature rise of the drive IC 10 including the control section 5. Heat generated by these limiting resistances is transmitted to the LED elements via the bonding wires 2, thus resulting in a reduced light emission output.

The limiting resistances are once dropped onto the substrate by the bonding wires and further are connected from the substrate to the LED chip by the bonding wires, whereby the heat is discharged to the substrate and the heat conducting action is alleviated, but the number of bonding wires becomes double, and when a recording head of high resolution and great length is to be realized, it is unrealistic in terms of cost.

Also, to place only these limiting resistances out of the drive IC 10 and dispose them at a location thermally remote from the LED chip 1, thousands of chip resistances must be mounted discretely from the drive IC and thus, the substrate itself becomes bulky, and this also is unrealistic.

SUMMARY OF THE INVENTION

It is the object of the present invention to provide a light-emitting device such as an LED head which is driven with the influence of heat more suppressed relative to a light-emitting element such as an LED and suffers less from the fluctuation of its output.

The light emitting device of the present invention comprises N arranged light-emitting elements divided into M groups of light-emitting elements, one terminal of the light-emitting elements in the groups of light-emitting elements which are identical in the order of arrangement being connected in common, and connected to first drive means for successively driving the light-emitting elements in the groups of light-emitting elements which are identical in the order of arrangement, the other terminals of the light emitting elements in the groups of light-emitting elements being connected in common for each group of light-emitting elements, and connected to resistance means provided for each group of light-emitting elements, the resistance means being connected to second drive means for successively driving each group of light-emitting elements.

In the light-emitting device of the present invention, N arranged light-emitting elements are divided into M groups of light-emitting elements, the light-emitting elements in each group of light-emitting elements are successively driven by the first drive means, and the light-emitting elements are successively driven by the second drive means for each group of light-emitting elements, whereby the N arranged light-emitting elements are time-divisionally driven to emit light, and it will suffice if the resistance for limiting the driving current for the light-emitting elements is provided for each of the (M) groups of light-emitting elements and therefore, the number of resistances may be M (<N), and even if the resistances are disposed at locations separated from the light-emitting elements, the increase in area by the resistances and wiring can be greatly suppressed as compared with a case where as in the example of the prior art shown in FIGS. 1A and 1B, a resistance is provided for each light-emitting element.

In the above-described light-emitting device of the present invention, if the resistances are disposed at locations thermally separated from the light-emitting elements, the fluctuation of the characteristic of the light-emitting elements by the heat from the resistances can be suppressed.

Also, in the above-described light-emitting device of the present invention, if at least the aforementioned N arranged light-emitting elements are disposed on one main surface of a substrate and the resistances are disposed on the other main surface of the substrate, the thermal separation of the light-emitting elements and the resistances can be effected more effectively.

Also, if the light-emitting elements and the resistances are disposed on discrete substrates, the thermal separation thereof can be effected more effectively.

Further, in the above-described light emitting device of the present invention, if the width of a wiring pattern connecting the resistance and the second drive means together is made greater than the width of a wiring pattern connecting the light-emitting elements in a group of light-emitting elements and the resistance together, the heat can be discharged chiefly to the wiring on the second drive means side and the heat conduction to the wiring on the light-emitting element side can be suppressed. Further, by attaching a heat radiating material to the thicker wiring pattern, the heat radiation effect can be enhanced.

DESCRIPTION OF THE PREFERRED EMBODIMENTS

The invention will hereinafter be described in detail with respect to some embodiments thereof.

Figure 1A:
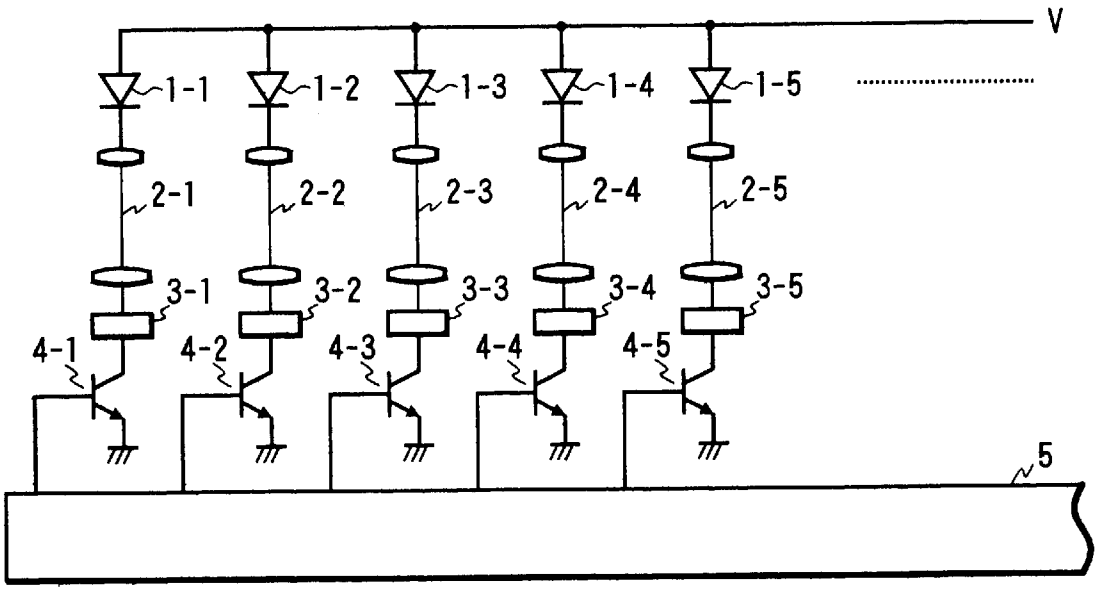
FIG. 1A PRIOR ART
FIGS. 1A and 1B are a schematic circuit diagram and a cross-sectional view, respectively, showing the construction of an LED head according to the prior art.
Figure 1B:
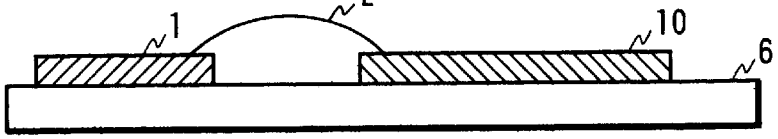
FIG. 1B PRIOR ART
Figure 2A:
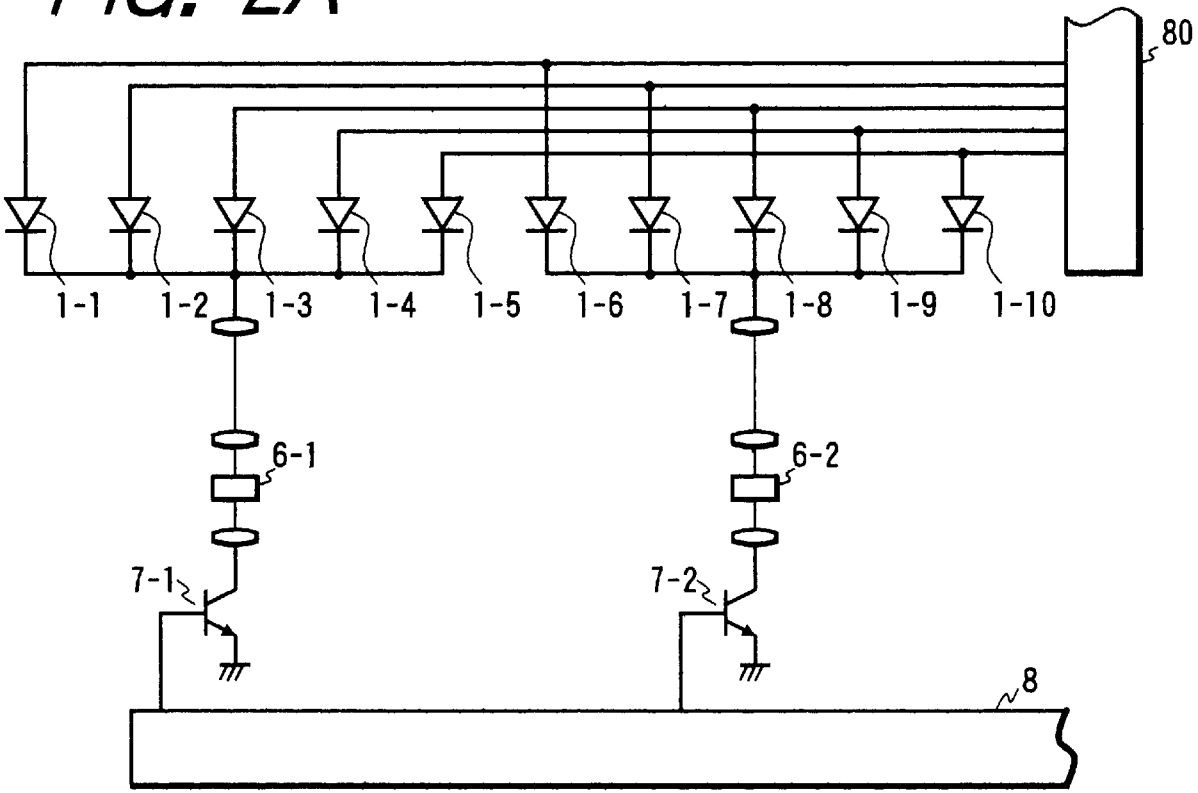
FIG. 2A is a schematic circuit diagram showing an embodiment of an LED head according to the present invention.
Figure 2B:
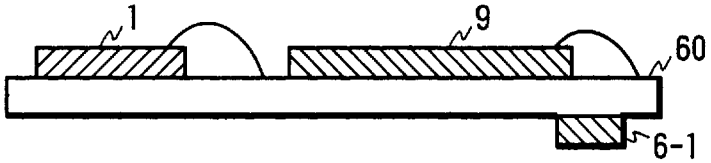
FIG. 2B is a cross-sectional view thereof.

FIG. 2A is a schematic circuit diagram showing an embodiment of an LED head according to the present invention, and FIG. 2B is a cross-sectional view thereof. Herein, LED elements are shown as groups of five light-emitting elements each (that is, assuming that the number of LED elements arranged in an LED chip 1 is N and they are divided into M groups, N/M=5).

As shown in these figures, the LED elements (1-1 to 1-5, 1-6 to 1-10, . . . , 1-N) in the respective groups of light-emitting elements are so-called matrix-connected with their cathode sides connected in common for each group of light-emitting elements and with the anode sides of the LED elements in the respective groups of light-emitting elements which are identical in the order of arrangement (e.g. 1-1, 1-6, . . . ) connected in common.

The anode sides connected in common of the LED elements in the respective groups of light-emitting elements which are identical in the order of arrangement are connected to first drive means 80 (comprised, for example, of a shift register and a transistor) for successively time-divisionally driving the LED elements in the respective groups of light-emitting elements which are identical in the order of arrangement. On the other hand, the cathode sides connected in common of the respective groups of light-emitting elements are connected to GND through limiting resistances (6-1, 6-2, . . . , 6-M) and transistors (7-1, 7-2, . . . , 7-M). The transistors (7-1, 7-2, . . . , 7-M) are controlled by a control unit 8 for time-divisionally driving each group of light-emitting elements. The transistors 7-1 to 7-M and the control unit 8 together constitute second drive means. The first drive means 80, like the LED elements (1-1 to 1-5, 1-6 to 1-10, . . . ), is disposed on an LED chip 1. The transistors (7-1, 7-2, . . . , 7-M) and the control unit 8 are provided in a drive IC 9.

To turn on the LED element 1-1, the anode side thereof on which the LED element 1-1 is connected is scanned by the first drive means 80 and a predetermined voltage is applied to the anode side, and at that timing, the transistor 7-1 is turned on by the second drive means 8. Likewise, to turn on the LED element 1-2, the anode side thereof on which the LED element 1-2 is connected is scanned by the first drive means 80 and a predetermined voltage is applied to the anode side, and at that timing, the transistor 7-1 is turned on by the second drive means 8. In the same manner, the LED elements 1-3 to 1-5 are turned on in succession, whereafter a predetermined voltage is applied to the anode sides of the LED elements 1-6 to 1-10 in the next group of light-emitting elements in succession, and at that timing, the transistor 7-2 is turned on. In this manner, all LED elements (1-1 to 1-5, 1-6 to 1-10, . . . , 1-N) are turned on in succession. The control unit 8 controls this time-divisional driving. The control unit 8 here turns on the transistor 7-1 in accordance with the timing for applying the predetermined voltage to the anode sides of the LED elements 1-1 to 1-5, but alternatively, the transistor 7-1 may always be turned on for the time during which the voltage is applied to the anodes of the LED elements 1-1 to 1-5 in succession. In any case, the transistor 7-1 and the control unit 8 drive the group of LED elements 1-1 to 1-5. Also, as shown in FIG. 2B, the LED chip 1, the drive IC 9 and the limiting resistance 6-1 are disposed on the same substrate 60.

According to this construction, the drive transistor 7-1 takes the LED elements 1-1, 1-2, . . . , 1-5, i.e., five elements under its charge, and the total number (M) of the limiting resistances 6 can be reduced to ⅕ of the total number (N) of the LED elements i.e., ⅕ of that in the prior art.

As a result, as shown in FIG. 2B, it becomes possible to place the limiting resistance 6-1 out of the drive IC 9 and thermally isolate it from the LED chip 1. Herein, the limiting resistances are disposed on that surface of the substrate 60 which is opposite to the surface thereof on which the LED chip 1 is disposed, but the resistances may of course be disposed on the surface on which the LED chip 1 is disposed if disposed at locations whereat the heat generation by the resistances does not pose a problem.

When a glass epoxy substrate 60 is used, the limiting resistance 6-1 mounted outside the drive IC 9 is mounted on the opposite surface of the LED chip 1, whereby the substrate itself alleviates the heat transferring action. Further, by the limiting resistance 6-1 being mounted on the same surface, it becomes possible to cool the limiting resistance chip itself hampering the application of the light of the LED elements to the other portion than a photosensitive member by the use of other radiator.

Even if in actual mounting, the limiting resistance chip 6-1 is kept away from the LED chip 1 itself, heat is transferred by a wiring pattern, but to alleviate the heat transferring action, it is effective to make the area of the wiring pattern from the limiting resistance chip 6-1 to the LED chip 1 sufficiently large and thick. Also, in the case of a both-surface substrate, it is effective for the alleviation of the heat transferring effect to use many through-holes at locations on the wiring pattern which are near the limiting resistance chip.

Description will hereinafter be made of an example of the construction when the area of the wiring pattern from the limiting resistance chip to the LED chip is secured sufficiently large.

Figure 3A:
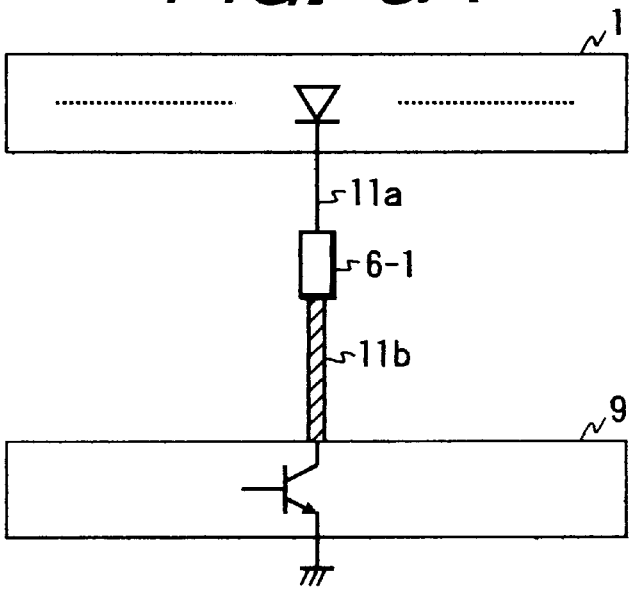
FIG. 3A is a schematic view showing the construction of one block of the LED head.
Figure 3B:
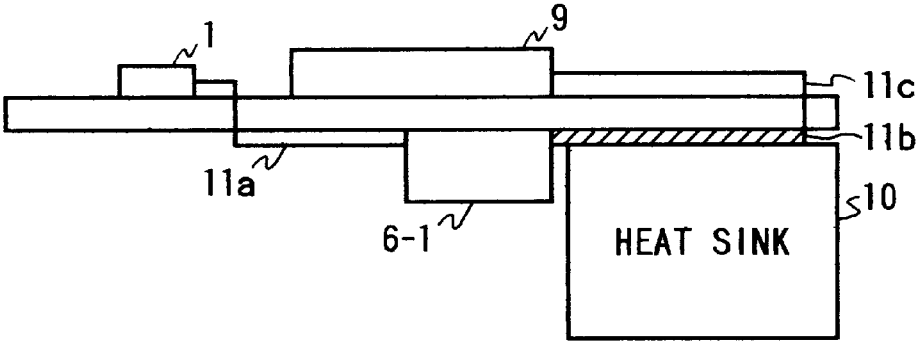
FIG. 3B is a cross-sectional view thereof.
Figure 3C:
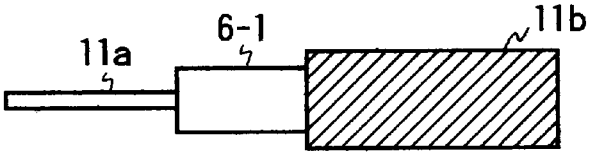
FIG. 3C is a fragmentary enlarged view thereof.

FIG. 3A is a schematic view showing the construction of one block of the LED head, FIG. 3B is a cross-sectional view thereof, and FIG. 3C is a fragmentary enlarged view thereof.

When heat generation is examined in the LED head in the one block of FIG. 3A, if the forward voltage VF of the LED is 1.6 V and the power source voltage is 5 V, the voltage applied to the resistance when the transistor in the drive IC 9 is ON is 3.4 V and thus, this voltage drop amount is consumed as generated heat by the resistance, and this heat of the resistance is transferred to the LED elements, and this creates a factor for reducing the quantity of emitted light of the LED elements.

The present example of the construction utilizes the fact that the heat of the limiting resistance chip is transferred chiefly through the wiring pattern and radiated. As shown in FIGS. 3A and 3B, the wiring pattern 11*a* of the limiting resistance chip which is adjacent to the LED elements is made thin and the wiring pattern 11*b* on the opposite side is made thick so that the heat of the limiting resistance chip may not be transferred to the LED elements as far as possible, and at the ratio of thickness, the heat is transferred to the thicker wiring pattern. By attaching a heat sink 10 to this thicker wiring pattern side as shown in FIG. 3B, it becomes possible that the heat is radiated before it is transferred to the LED elements.

Such a construction in which in order to suppress the transfer of the heat from the resistance to one wiring pattern, the resistance is disposed on the back side of the substrate or the width of the other wiring pattern is made great or a heat sink is attached to the other wiring pattern side is not restricted to the LED head shown in FIG. 3A to 3C, but is effective when it is connected to light-emitting elements which exhibits a great variation in characteristic by temperature.

In the above-described embodiment, the case of five-division driving is disclosed to simplify the description, but if the present invention is applied to an LED having the so-called self-scanning function capable of scanning around the LED elements in time division which is disclosed, for example, in Proposal of Self-Scanning Light-Emitting Device Using PNPN-Thyristor, Mar. 5, 1990, Electronics Information Communication Society, Technical Report OQE 89-141, 128 time-division driving will become possible and as a result, thermal isolation will become sufficiently possible when realizing a recording head capable of effecting high-density recording of the order of 600 DPI to 1200 DPI.

Figure 4:
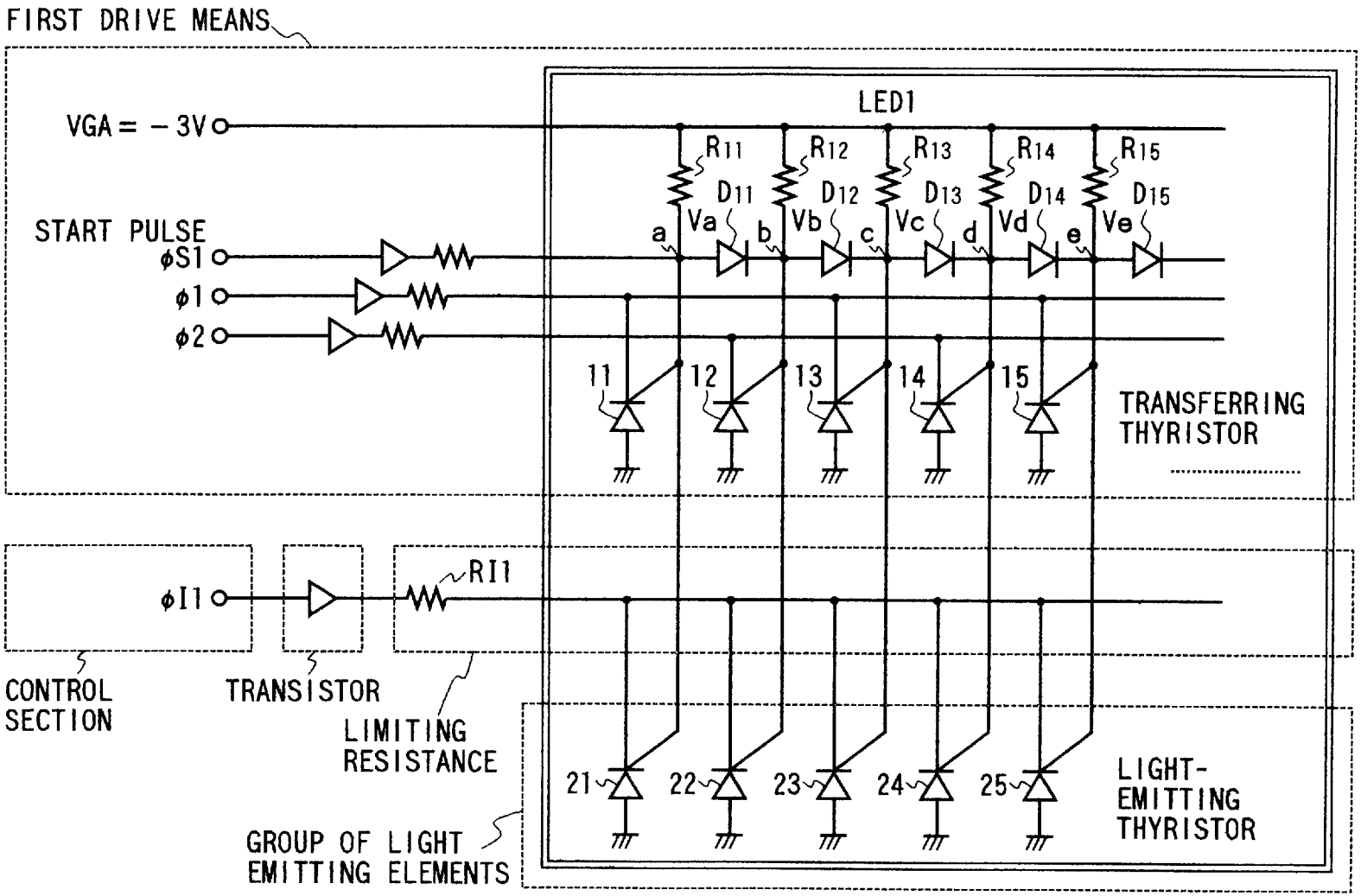
FIG. 4 is a circuit diagram of one block showing an embodiment of an LED using the present invention.
Figure 5:
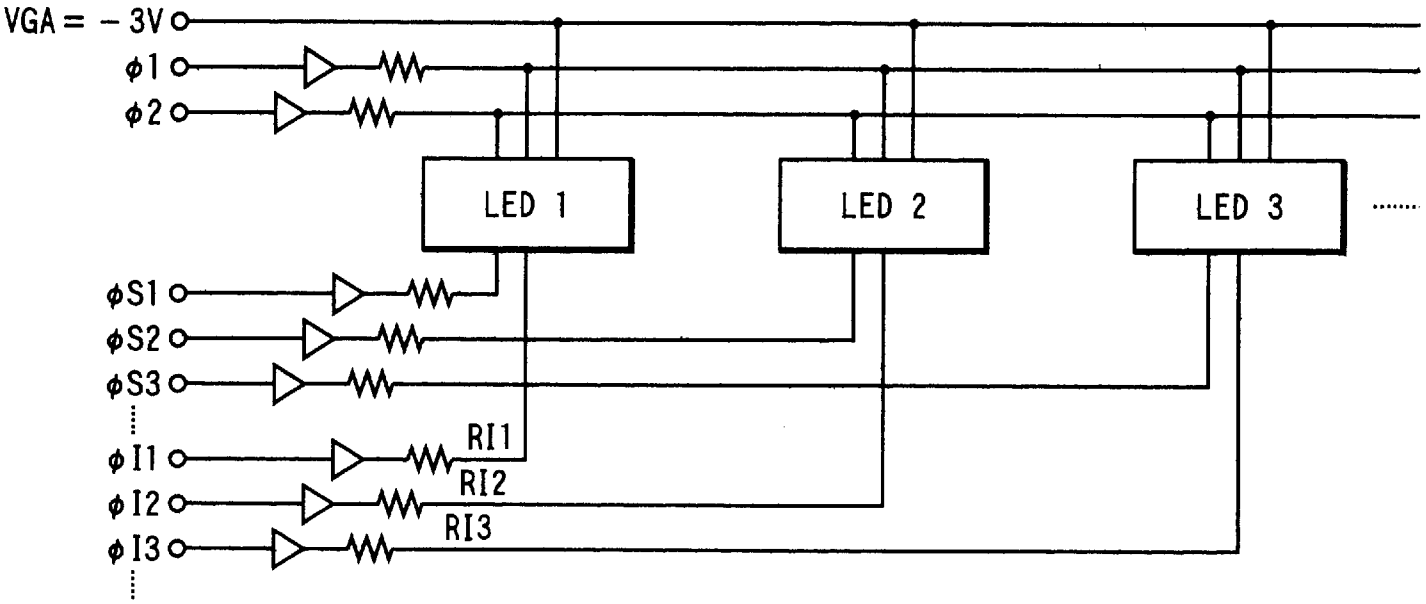
FIG. 5 is a circuit diagram showing the entire construction of the LED of FIG. 4.
Figure 6:
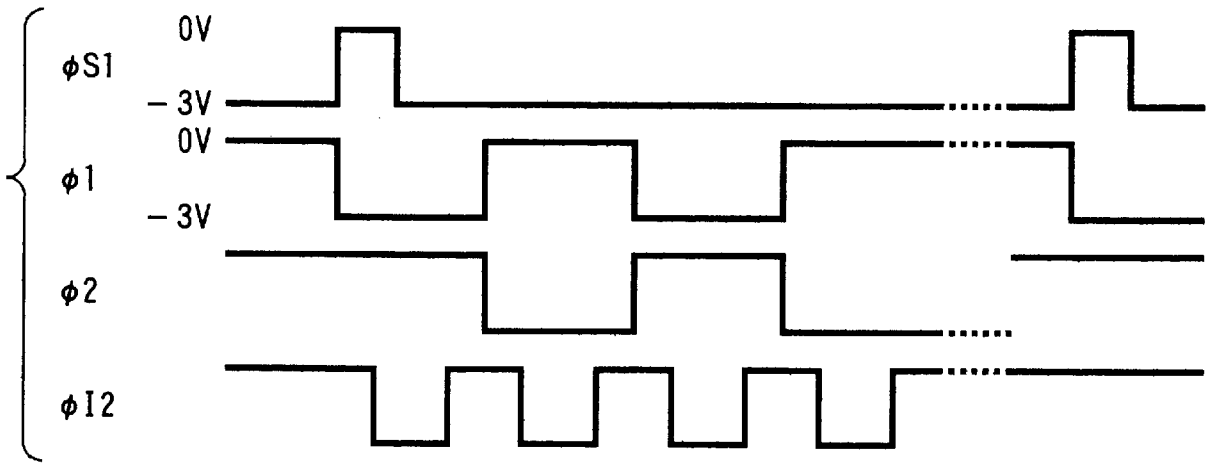
FIG. 6 shows a control signal and timing for controlling the LED.

FIG. 4 is a circuit diagram of one block showing an embodiment of the LED having the self-scanning function which uses the present invention, and FIG. 5 is a circuit diagram showing the entire construction thereof. FIG. 6 shows a control signal and timing for controlling this LED, and shows an example of a case where light emitting elements in one block are turned on.

VGA in FIG. 4 corresponds to the power source voltage of the LED element which is a light emitting element, and is connected to the anode sides of diodes $D_{11}$–$D_{15}$ cascade-connected to ϕS1 through the resistances $R_{11}$–$R_{15}$ of FIG. 4. The resistances $R_{11}$–$R_{15}$, the diodes $D_{11}$–$D_{15}$ and transferring light-emitting thyristors 11–15 provide the first drive means according to the present invention, light-emitting thyristors 21–25 provide the light-emitting elements according to the present invention, and a resistance RI1 connected in common to the light-emitting thyristors 21–25 provides the limiting resistance according to the present invention.

As shown in FIGS. 4 and 5, the block LEDs 1–3 of the LED start their operations by the application of start pulses ϕS1–3 thereto, and electric currents from the light-emitting thyristors of the respective block LEDs 1–3 flow through resistances RI1–3.

The LEDs in one block, as shown in FIG. 4, comprise transferring light-emitting thyristors 11–15 arranged in the form of an array and light-emitting thyristors 21–25 arranged in the form of an array, and the light-emitting gates of the respective light-emitting thyristors are connected in common, and the gates of the first light-emitting thyristors 11 and 21 are connected to the signal input section of ϕS1. The gates of the second light-emitting thyristors 12 and 22 are connected to the cathode of the diode $D_{11}$ connected to the terminal of ϕS1, and the gates of the third light-emitting thyristors 13 and 23 are connected to the cathode of the next diode $D_{12}$, and so on. The transferring and light-emitting operations will now be described with reference to the timing chart of FIG. 5. The transfer is started by varying ϕS1 from −3 V to 0 V. By ϕS1 becoming 0 V, Va=0 V, Vb=−1.3 V (the forward voltage drop of the diode being 1.3 V), Vc=−2.6 V, and Vd and subsequent voltages become −3 V and the gate signals of the transferring light-emitting thyristors 11 and 12 change from −3 V to 0 V and −1.3 V, respectively. By this state ϕ1 being changed from 0 V to −3 V, the potentials of the transferring light-emitting thyristor 11 become 0 V at the anode, −3 V at the cathode and 0 V at the gate, and this is the ON condition of the light-emitting thyristor, and even if ϕS1 is changed to −3 V in the state in which the transferring light-emitting thyristor 11 is ON, Va becomes nearly 0 V because the transferring light-emitting thyristor 11 is ON (because a pulse is being applied to ϕS through a resistance and when the light-emitting thyristor becomes ON, the potentials between the anode and the gate become substantially equal to each other). Therefore, even if ϕS1 is changed to −3 V, the ON condition of the first thyristor is held and the shift operation of the first thyristor is completed. When in this state, a signal ϕI1 for the light-emitting thyristor is changed from 0 V to −3 V, it becomes the same as the condition under which the transferring light-emitting thyristor 11 has become ON and therefore, the light-emitting thyristor 21 becomes ON and thus, the first LED is turned on. As regards the first LED, by ϕI1 being returned to 0 V, the potential difference between the anode and cathode of the light-emitting thyristor becomes null and the lowest holding current of the light-emitting thyristor becomes incapable of being flowed and therefore, the light-emitting thyristor 21 becomes OFF.

Description will now be made of the transfer of the ON condition from the light-emitting thyristor 11 to the light-emitting thyristor 12. Even when the light-emitting thyristor 21 becomes OFF, ϕ1 is still −3 V and therefore, the transferring light-emitting thyristor 11 remains ON and the gate voltage Va of the transferring light-emitting thyristor 11 is nearly 0 V, and Vb=−1.3 V. In this state, ϕ2 is changed from 0 V to −3 V, whereby the potential of the transferring light-emitting thyristor 12 becomes 0 V at the anode, −3 V at the cathode and −1.3 V at the gate and thus, the transferring light-emitting thyristor 12 becomes ON, Vb becomes nearly 0 V. After the transferring light-emitting thyristor 12 has become ON, ϕ1 is changed from −3 V to 0 V, whereby the transferring light-emitting thyristor 11 becomes OFF like the light-emitting thyristor 21 has become OFF. Thus, the ON state of the transferring light-emitting thyristor shifts from 11 to 12. When ϕ1 is then changed from 0 V to −3 V, the light-emitting thyristor 22 becomes ON and emits light. The reason why the light-emitting thyristor alone can emit light for the time during which the transferring light-emitting thyristor is ON does not become the ON condition of the light-emitting thyristor because the gate voltage is −3 V except for the light-emitting thyristor neighboring the light-emitting thyristor which is ON. With regard also to the neighboring light-emitting thyristor, the potential of ϕI1 becomes −1.6 V (corresponding to the forward voltage drop of the light-emitting thyristor) by the light-emitting thyristor becoming ON and therefore, the neighboring light-emitting thyristor cannot become ON because there is no potential difference between the gate and cathode thereof.

Description will hereinafter be made of a specific embodiment of an image forming apparatus using the above-described LED head of the present invention.

Figure 7:
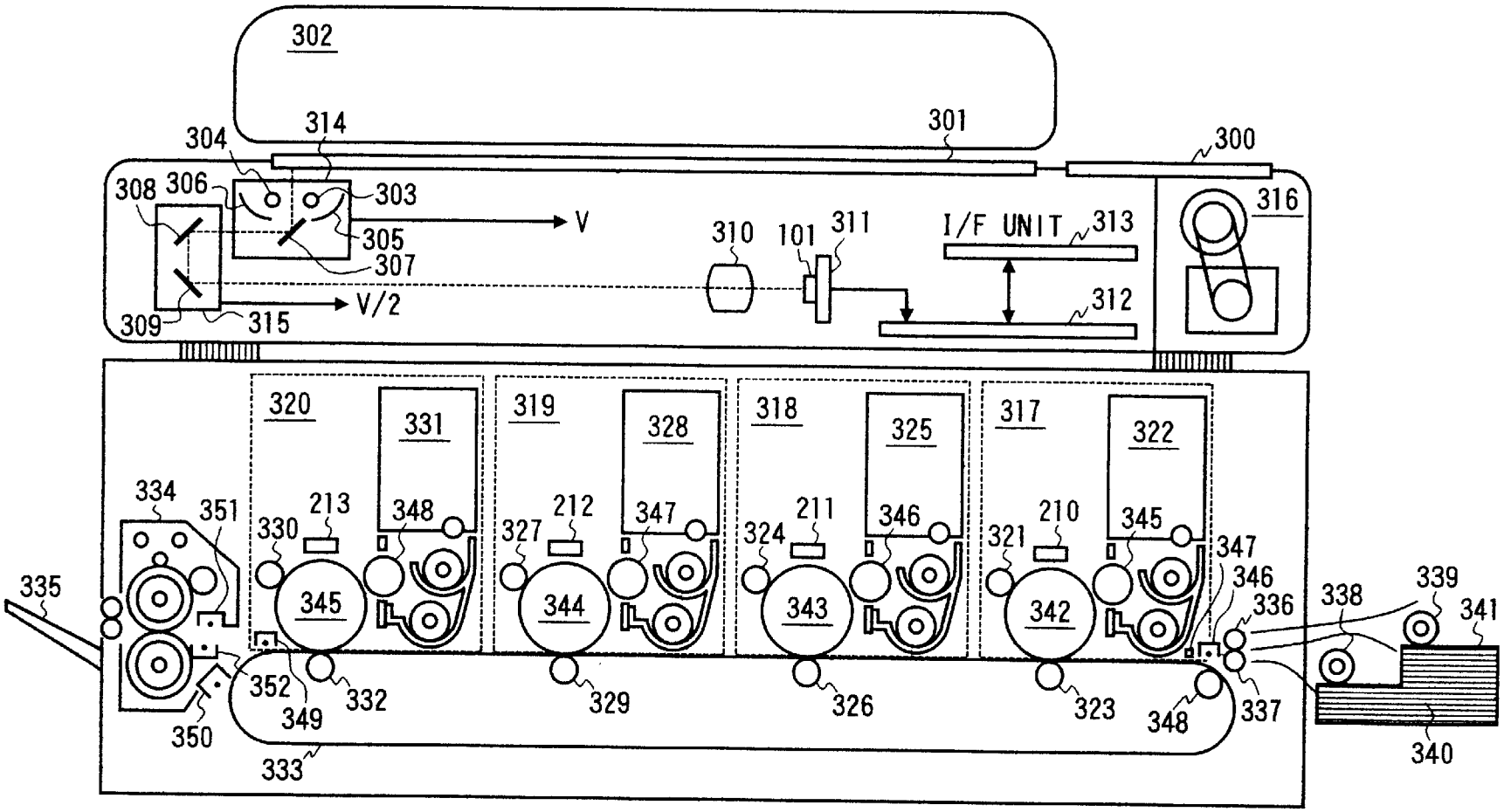
FIG. 7 is a schematic view showing the construction of a color copying apparatus using the LED head of the present invention.
Figures 8, 8A:
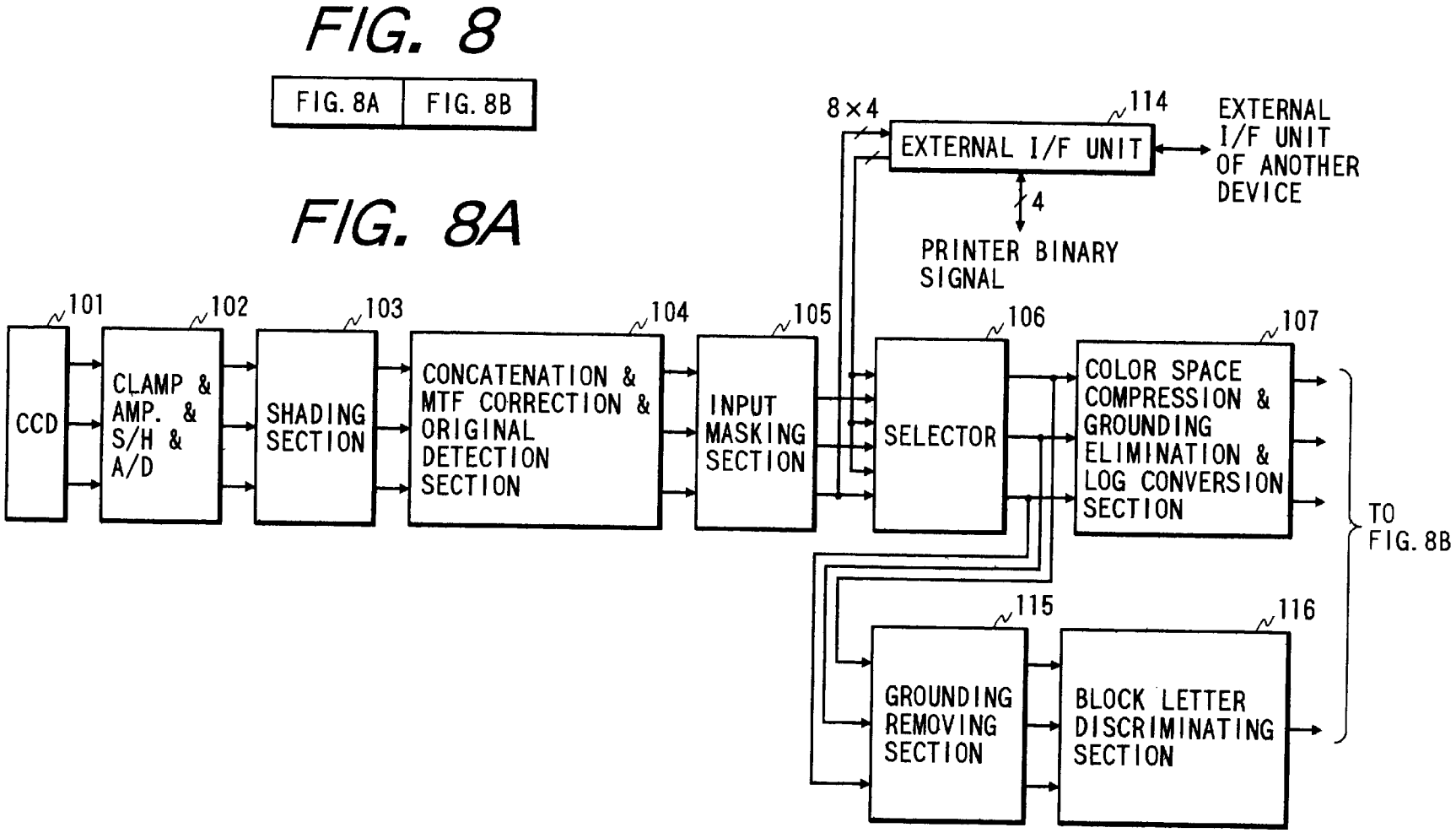
FIG. 8 is comprised of FIGS. 8A and 8B illustrating block diagrams showing the detailed construction of a digital image processing unit 312.
Figure 8B:
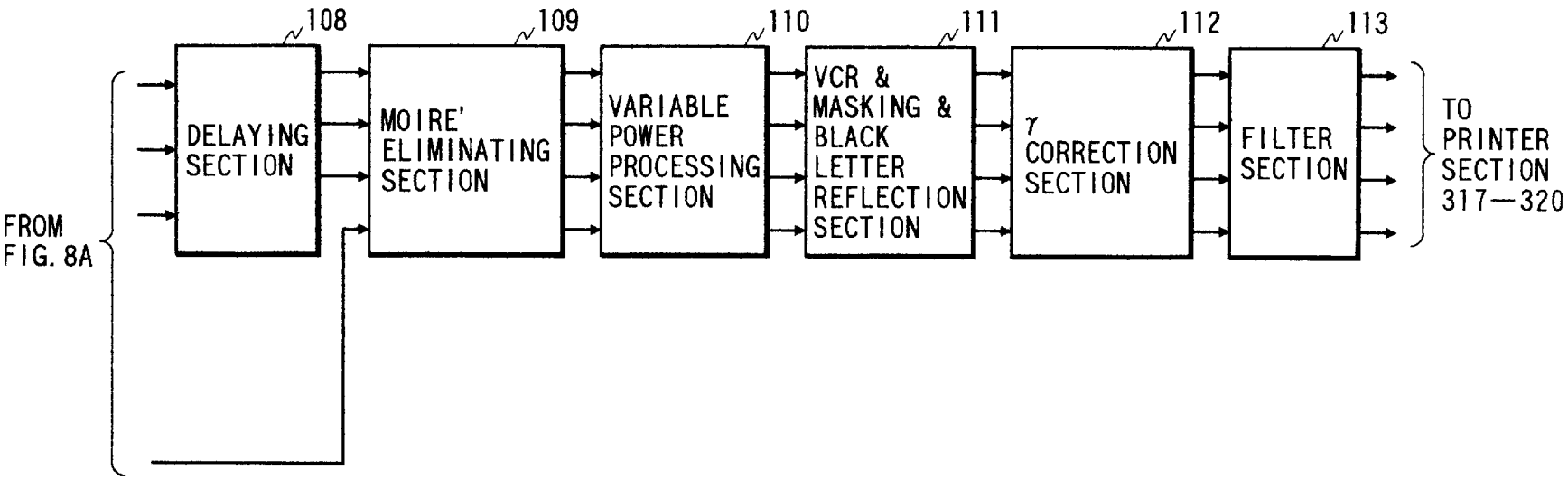
Figure 9:
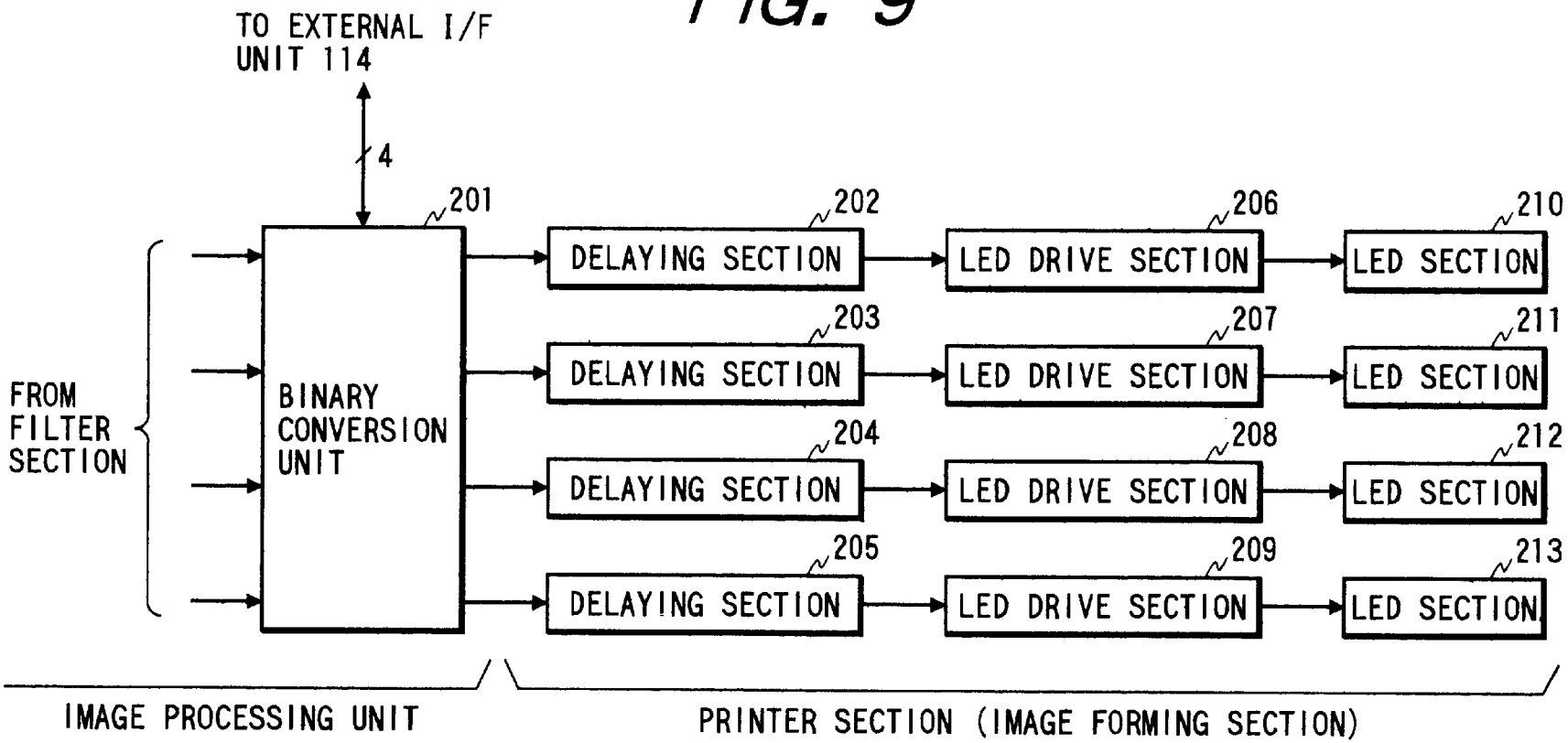
FIG. 9 is a block diagram showing the construction of an LED image recording unit.

FIG. 7 is a schematic view showing the construction of a color copying apparatus using the LED head of the present invention, FIGS. 8A and 8B are block diagrams showing the construction of a digital image processing unit 312, and FIG. 9 is a block diagram showing the construction of an LED image recording unit.

The construction of the color copying apparatus of FIG. 7 will hereinafter be described while being divided into a color reader section and a printer section, and the LED head of the present invention constitutes an LED drive unit and an LED unit in the printer section which will be described later.

(Color Reader Section)

The color reader section is shown in the upper portion of FIG. 7. In FIG. 7, reference numeral 101 designates a CCD, reference numeral 311 denotes a substrate on which the CCD 101 is mounted, reference numeral 312 designates an image processing unit including the other portions than the portion 101 of the image processing unit of FIG. 8A and the portions 201 and 202–205 of FIG. 9, reference numeral 301 denotes original supporting table glass (platen), reference numeral 302 designates an original supplying device (DF) (there is also a construction in which a mirror surface pressure plate is mounted instead of this original supplying device 302), reference numerals 303 and 304 denote light sources (halogen lamps or fluorescent lamps) for illuminating an original, reference numerals 305 and 306 designate reflectors for condensing the light of the light sources 303 and 304 onto the original, reference numerals 307–309 denote mirrors, reference numeral 310 designates a lens for condensing the reflected light or the projected light from the original onto the CCD 101, reference numeral 314 denotes a carriage containing the halogen lamps 303, 304, the reflectors 305, 306 and the mirror 307 therein, reference numeral 315 designates a carriage containing the mirrors 308 and 309 therein, and reference numeral 313 denotes an interface (I/F) section with other IPU, etc. The carriages 314 and 315 are mechanically moved at velocity V and velocity V/2, respectively, perpendicularly to the direction of electrical scanning (main scanning) of the CCD 101 to thereby scan (sub-scan) the whole surface of the original. Reference numeral 300 designates the operating portion of the copying apparatus, and reference numeral 316 denotes drive means for the carriages 314 and 315.

FIGS. 8A and 8B are block diagrams showing the detailed construction of the digital image processing unit 312. The original on the original supporting table glass reflects the light from the light sources 303 and 304, and the reflected light is directed to the CCD 101 and is converted into an electrical signal (the CCD 101, when it is a color sensor, may be of a construction in which red, green and blue color filters rest in line on a one-line CCD in the order of red, green and blue, or may be a three-line CCD in which a red filter, a green filter and a blue filter are arranged for respective CCDs, or a construction in which filters are made into on-chips or filters are discrete from CCDs). The electrical signal (analog image signal) is inputted to the image processing unit 312, is sample-held (S/H) by a clamp & Amp. & S/H & A/D section 102, has the dark level thereof clamped at a reference potential, is amplified to a predetermined amount (the above-described order of processing is not limited thereto), is A/D-converted, e.g. converted into a digital signal of 8 bits for each of R, G and B. The RGB signal is subjected to shading correction and black correction by a shading section 103, and in a concatenation & MTF correction & original detection section 104, when the CCD 101 is a three-line CCD, as the concatenation process, the amount of delay for each line is adjusted in conformity with the reading speed and the signal timing is corrected so that the reading positions of the three lines may become the same because the reading positions of the three lines differ from one another, as MTF correction, since the MTF of reading varies depending on the reading speed and the variable power rate, the variation is corrected, and as original detection, the original on the original supporting table glass is scanned, whereby the size of the original is recognized. The digital signal of which the reading position timing has been corrected corrects the spectral characteristic of the CCD 101 and the spectral characteristics of the light sources 303, 304 and the reflectors 305, 306 by an input masking section 105. The output of the input masking section 105 is inputted to a selector 106 capable of changing over with an external I/F signal from an external I/F unit 114 in the I/F section 313. A signal outputted from the selector 106 is inputted to a color space compression & grounding illumination & LOG conversion section 107 and a grounding removing section 115. The signal inputted to the grounding removing section 115 has its grounding removed, whereafter it is inputted to a black letter discriminating section 116 for discriminating whether the letters in the original are black letters, and produces a black letter signal from the original. Also, in the color space compression & grounding elimination & LOG conversion section 107 to which another output of the selector 106 has been inputted, the color space compression judges whether the read image signal is within a range which can be reproduced by the printer, and if it is within that range, the image signal is left as it is, and if it is not within that range, the image signal is corrected so as to be within the range which can be reproduced by the printer. Then, the color space compression & grounding elimination & LOG conversion section 107 carries out the grounding elimination process, and converts the RGB signal into a CMY signal by LOG conversion. In order to correct the signal and timing produced by the black letter discriminating section 116, the output signal of the color space compression & grounding elimination & LOG conversion section 107 has its timing adjusted by a delaying section 108. These two kinds of signals have their moiré eliminated by a moiré eliminating section and are variable-power-processed in the main scanning direction by a variable power processing section 110. Reference numeral 111 designates a UCR & masking & black letter reflection section, and as regards the signals processed by the variable power processing section 110, a CMY signal is UCR-processed to produce a CMYK signal, which is corrected into a signal matching the output of the printer by the masking process section, and the discrimination signal produced by the black letter discriminating section 116 is fed back to the CMYK signal. The signal processed by the UCR & masking & black letter reflection section 111 is density-adjusted by a y correction section 112, and thereafter is smoothed or edge-processed by a filter section 113. The signal processed as described above is converted from a multivalue signal of 8 bits into a binary signal by a binary conversion unit 201 shown in FIG. 9. (The conversion method may be any one of the dither method, the error diffusing method and an improvement over the error diffusing method.)

(Printer Section)

The printer section is shown in the lower portion of FIG. 7. Reference numeral 317 designates an M image forming unit, reference numeral 318 denotes a C image forming unit, reference numeral 319 designates a Y image forming unit, and reference numeral 320 denotes a K image forming unit. These units are identical in construction to one another and therefore, herein, the M image forming unit 317 will be described in detail and the description of the other image forming units will be omitted. The LED head of the present invention constitutes LED drive sections 206–209 and LED sections 210–213 which are shown in FIG. 9.

As shown in FIG. 7, in the M image forming unit 317, reference numeral 342 designates a photosensitive drum, on the surface of which a latent image is formed by the light from the LED section 210. Reference numeral 321 denotes a primary charger which charges the surface of the photosensitive drum 342 to a predetermined potential and prepares for latent image formation. Reference numeral 322 designates a developing device which develops the latent image on the photosensitive drum 342 to thereby form a toner image. The developing device 322 includes a sleeve 345 for applying a developing bias to thereby develop the latent image. Reference numeral 323 denotes a transfer charger which effects discharging from the back of a transfer belt 333 to thereby transfer the toner image on the photosensitive drum 342 to a recording sheet or the like on the transfer belt 333. In the present embodiment, transfer efficiency is good and therefore, a cleaner unit is not disposed (of course, there will be no problem even if a cleaner unit is mounted).

Description will now be made of the procedure of forming an image or a recording sheet or the like. Recording sheets or the like stored in cassettes 340 and 341 are supplied one by one onto the transfer belt 333 by paper supply rollers 336 and 337 with the aid of pickup rollers 339 and 338. The thus supplied recording sheet is charged by an adsorption charger 346. Reference numeral 348 designates a transfer belt roller which drives the transfer belt 333 and charges the recording sheet or the like in pair with the adsorption charger 346, thereby adsorbing the recording sheet or the like to the transfer belt 333. Reference numeral 347 denotes a paper leading end sensor which detects the leading end of the recording sheet on the transfer belt 333. The detection signal of the paper leading end sensor is sent from the printer section to the color reader section for use as a sub-scanning synchronous signal when a video signal is sent from the color reader section to the printer section.

Thereafter, the recording sheet or the like is conveyed by the transfer belt 333 and in the image forming units 317–320, toner images are formed on the surface thereof in the order of MCYK. The recording sheet or the like having passed through the K image forming unit 320 has its charge removed by a charge removing charger 349 to facilitate the separation thereof from the transfer belt 333, whereafter it is separated from the transfer belt 333. Reference numeral 350 designates a peeling charger which prevents the disturbance of the image by the peeling discharge when the recording sheet or the like is separated from the transfer belt 333. The thus separated recording sheet or the like is charged by pre-fixation charges 351 and 352 to supplement the adsorption force of the toner and prevent the disturbance of the image, whereafter the recording sheet or the like has the toner image thereon heat-fixated by a fixating device 334, and thereafter is discharged onto a paper discharge tray 335.

The image recording by the LED head will now be described. As shown in FIG. 9, the binary CMYK image signals produced by the image processing unit of FIGS. 8A and 8B and the signal produced by the binary conversion unit 201 on the basis of the paper leading end signal from the paper leading end sensor 347 become capable of printing four colors at a predetermined position by the differences in the distances between the paper leading end sensor and the respective image forming units 317–320 being adjusted by the delaying sections 202–205. The LED drive sections 206–209 produce signals for driving the LED sections 210–213. The light emitting elements (LED sections) arranged in rows emit light or are turned off in conformity with a recording signal (image signal), whereby recording is effected on the photosensitive drum.

Figure 10:
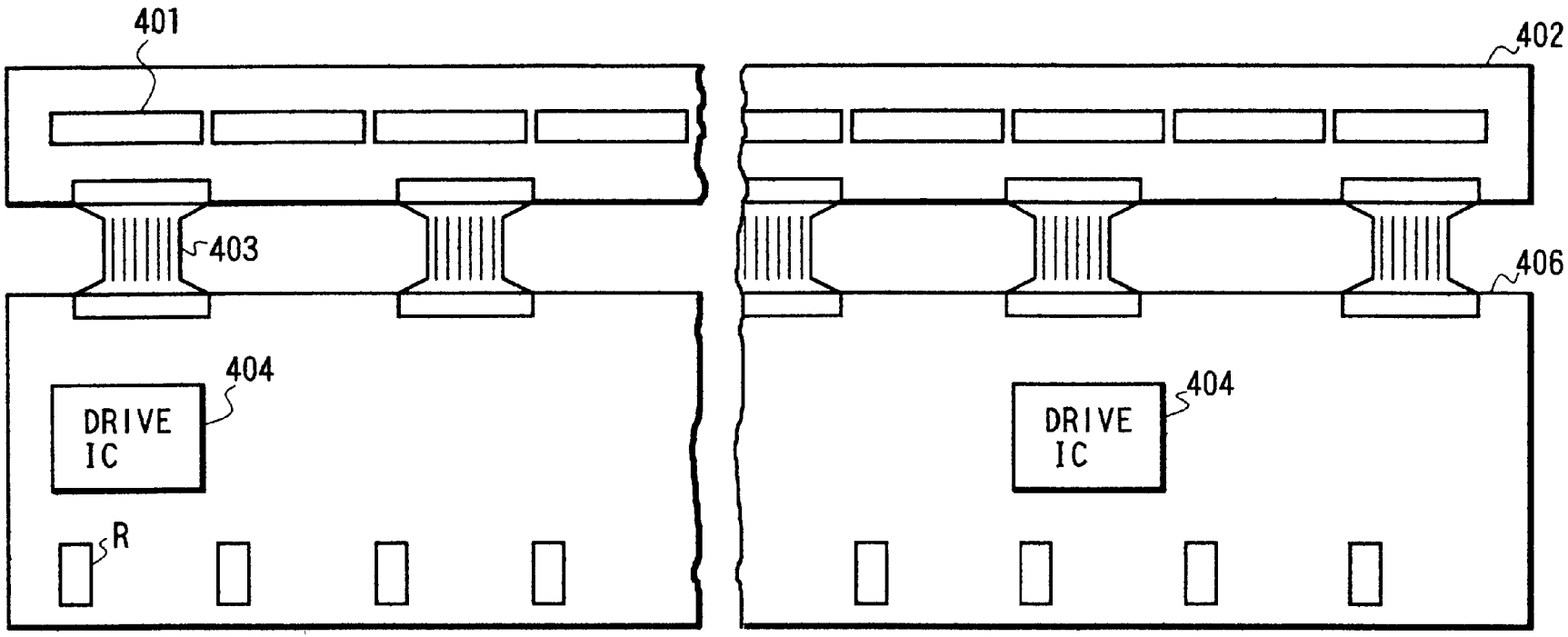
FIG. 10 shows another embodiment of the LED head of the present invention.

FIG. 10 shows another embodiment of the LED head of the present invention.

The LED head shown in FIG. 10 is a recording head having a recording element array comprising a plurality of recording elements arranged in a row, and effecting recording by controlling the recording elements in conformity with a recording signal to be recorded, wherein the recording element array and a drive element for driving the recording elements are carried on discrete substrates, and the substrate on which the recording element array is carried and the substrate on which the drive element is carried are connected together by wiring.

In FIG. 10, reference numeral 401 designates a light-emitting element array chip in which a plurality of light-emitting elements (LED elements) are formed in a row on the same wafer. The light-emitting element array chip 401 has first drive means having a self-scanning circuit therein, and is designed to be capable of emitting light in succession by a light-emitting signal and three scanning signals per light-emitting element array chip. A plurality of such light-emitting element array chips 401 are carried in a row on a substrate 402.

Reference numeral 404 denotes drive ICs having second drive means for driving the light-emitting element array chips 401. In the present embodiment, design is made such that five light-emitting element array chips 401 are driven by a drive IC 404. These drive ICs 404 are carried on a substrate 406 discrete from the substrate 402 on which the light-emitting element array chips 401 are carried. On the substrate 406, there are carried a current limiting resistances R for limiting a drive current, besides the drive ICs 404. One such current limiting resistance R is necessary for one light-emitting element array chip 401, as previously described with respect to FIGS. 2A and 2B, and is provided correspondingly to each one of the light-emitting element array chips 401. On the substrate 406, there are also provided a connector and a condenser (not shown) for connection with the outside. The substrate 402 and the substrate 406 are connected together by wiring, and herein are connected together by the use of a flexible cable 403.

As described above, the light-emitting element array chips 401 are endowed with the self-scanning function, whereby the number of the wires between the substrate 402 on which the light-emitting element array chips 401 are mounted and the substrate 406 on which the drive ICs 404 are mounted can be reduced to one several tenth of that in the prior art. Accordingly, ordinary bundle wires, cables or the like are usable as the wires between the two substrates 402 and 406, and this enables the substrate 402 for the light-emitting element array chips 401 to be kept away from the other substrate 406 for the drive ICs 404, etc.

Also, not only it is difficult for the heat of the current limiting resistances R and drive ICs 404 on the substrate 406 to be transferred to the substrate 402, but also the current limiting resistances R and the drive IC chips 404 can be kept away from the light-emitting element array chips 401 and thus, the influence thereof on the light-emitting element array chips 401 can be remarkably reduced as compared with the prior art. Accordingly, thermally stable light emission outputs become obtainable in the light-emitting element array chips 401, and as the substrate 402 carrying them thereon, use need not be made of one particularly small in coefficient of thermal expansion and therefore, the costs can be reduced.

As described above, according to the present invention, as compared with the prior art, the number of the resistances can be greatly decreased, and even if the resistances are disposed at locations separate from the light-emitting elements, the increase in area by the resistances and wiring can be greatly suppressed as compared with a case where a resistance is provided for each light-emitting element.

If the resistances and the light-emitting elements are provided on discrete substrates and are disposed at thermally separated locations, the fluctuation of the characteristic of the light-emitting elements by the heat from the resistances can be suppressed.

Also, if the aforedescribed at least N arranged light-emitting elements are disposed on one main surface of a substrate and the resistances are disposed on the other main surface of this substrate, the thermal separation of the light-emitting elements and the resistances can be effected more effectively.

Also, if the width of the wiring pattern connecting the resistances and the second drive means together is made greater than the width of the wiring pattern connecting the light-emitting elements and resistances in one group together, the heat can be discharged chiefly to the wiring on the second drive means side and the heat conduction to the wiring on the light-emitting element side can be suppressed.

What is claimed is:

1. A light-emitting device comprising:

a plurality of light-emitting element groups, each comprised of a plurality of light-emitting elements;

first drive means for driving said plurality of light-emitting elements in succession;

a plurality of resistance means, each of said plurality of resistance means being connected to a corresponding one of said plurality of light-emitting element groups, such that each of said plurality of resistance means is connected in common to said plurality of light-emitting elements in the corresponding one of said plurality of light-emitting element groups;

second drive means for driving said plurality of light-emitting element groups;

a first wiring pattern having a first width and connecting said plurality of light-emitting element groups and said plurality of resistance means; and a second wiring pattern having a second width and connecting said plurality of resistance means and said second drive means, wherein the second width of said second wiring pattern is greater than the first width of said first wiring pattern.

2. A light-emitting device according to claim 1, wherein said plurality of resistance means are disposed at a location thermally isolated from said plurality of light-emitting elements.

3. A light-emitting device according to claim 1, said light-emitting device further comprising a first substrate including a first main surface and a second main surface, wherein said plurality of light-emitting elements are disposed on said first main surface of said first substrate, and said plurality of resistance means are disposed on said second main surface of said first substrate.

4. A light-emitting device according to claim 1, wherein a radiating plate is attached to said second wiring pattern.

5. A light-emitting device according to claim 1, said light-emitting device further comprising a first substrate and a second substrate, wherein said plurality of light-emitting elements are disposed on said first substrate, and said plurality of resistance means are disposed on said second substrate.

6. An image forming apparatus comprising:

a plurality of light-emitting element groups, each comprised of a plurality of light-emitting elements;

first drive means for driving said plurality of light-emitting elements in succession;

a plurality of resistance means, each of said plurality of resistance means being connected to a corresponding one of said plurality of light-emitting element groups, such that each of said plurality of resistance means is connected in common to said plurality of light-emitting elements in the corresponding one of said plurality of light-emitting element groups;

second drive means for driving said plurality of light-emitting element groups;

a photosensitive medium on which recording is effected by said plurality of light-emitting elements;

a first wiring pattern having a first width and connecting said plurality of light-emitting element groups and said plurality of resistance means; and a second wiring pattern having a second width and connecting said plurality of resistance means and said second drive means, wherein the second width of said second wiring pattern is greater than the first width of said first wiring pattern.

7. An image forming apparatus according to claim 6, wherein said plurality of resistance means are disposed at a location thermally isolated from said plurality of light-emitting elements.

8. An image forming apparatus according to claim 6, said image forming apparatus further comprising a first substrate including a first main surface and a second main surface, wherein said plurality of light-emitting elements are disposed on said first main surface of said first substrate, and said plurality of resistance means are disposed on said second main surface of said first substrate.

9. An image forming apparatus according to claim 6, wherein a radiating plate is attached to said second wiring pattern.

10. An image forming apparatus according to claim 6, said image forming apparatus further comprising a first substrate and a second substrate wherein said plurality of light-emitting elements are disposed on said first substrate, and said plurality of resistance means are disposed on said second substrate.

* * * * *

UNITED STATES PATENT AND TRADEMARK OFFICE

CERTIFICATE OF CORRECTION

PATENT NO. : 6,008,833
DATED : December 28, 1999
INVENTOR(S) : Toshihiko Ohtsubo et al.

It is certified that error appears in the above-identified patent and that said Letters Patent is hereby corrected as shown below:

Title page,
Item [56], References Cited, U.S PATENT DOCUMENTS

| | | | | |
|---|---|---|---|---|
| Insert: -- | 4,855,763 | 08/1989 | Kan, deceased et al. | 346/160.1 |
| | 4,920,361 | 04/1990 | Arahara et al. | 346/140 R |
| | 5,008,690 | 04/1991 | Koizumi et al. | 346/140 R |
| | 5,063,451 | 11/1991 | Yanagisawa et al. | 346/143 |
| | 5,093,675 | 03/1992 | Koumura et al. | 346/143 |
| | 5,315,382 | 05/1994 | Tanioka | 358/523 |
| | 5,451,977 | 09/1995 | Kusuda et al. | 345/44 -- |

OTHER DOCUMENTS,
Insert: -- Kusuda, Y., et al., "Proposal of the Self-scanning Light Emitting Device Using PNPN-thyristor," Institute of Electronics, Information and Communication Engineers (IEICE), OQE 89-141, Vol. 89, No. 443, pp 43-47 (03/1990). --

[*] Notice
Insert -- [*] NOTICE: This patent issued on a Continued Prosecution Application filed under 37 CFR 1.53 (d), and is subject to the twenty year patent term provisions of 35 U.S.C. 154 (a) (2). --

Column 1,
Line 20, "accord ing" should read -- according --.

Column 2,
Line 29, "where as" should read -- whereas --.

Column 8,
Line 52, "y correction" should read -- $\gamma$ correction --.

UNITED STATES PATENT AND TRADEMARK OFFICE

CERTIFICATE OF CORRECTION

PATENT NO. : 6,008,833
DATED : December 28, 1999
INVENTOR(S) : Toshihiko Ohtsubo et al.

It is certified that error appears in the above-identified patent and that said Letters Patent is hereby corrected as shown below:

Column 9,
Line 53, "charges 351" should read -- chargers 351 --.

Column 10,
Line 49, "tenth" should read -- tenths --.

Signed and Sealed this

Fifth Day of March, 2002

*Attest:*

*Attesting Officer*

JAMES E. ROGAN
*Director of the United States Patent and Trademark Office*